United States Patent [19]

Curley et al.

[11] Patent Number: 4,855,548

[45] Date of Patent: Aug. 8, 1989

[54] KEYBUTTON GUIDE ASSEMBLY FOR A KEYBOARD

[75] Inventors: Charles M. Curley, Ithaca; Scott J. Longrod, Lansing, both of N.Y.

[73] Assignee: Smith Corona Corporation, Cortland, N.Y.

[21] Appl. No.: 209,163

[22] Filed: Jun. 17, 1988

[51] Int. Cl.[4] ..... H01H 13/70

[52] U.S. Cl. ..... 200/345; 200/5 A; 400/496

[58] Field of Search ..... 200/344, 345, 517, 5 A; 400/490, 491.2, 491, 495, 496

[56] References Cited

U.S. PATENT DOCUMENTS

| | | | |
|---|---|---|---|
| 3,826,882 | 7/1974 | Giollitti et al. | 200/5 A |
| 3,879,602 | 4/1975 | Walker | 200/5 A X |
| 4,188,137 | 2/1980 | Dannatt | 400/496 |
| 4,269,521 | 5/1981 | Longrod | 400/472 |
| 4,315,114 | 2/1982 | Monti, Jr. | 200/5 A |
| 4,440,515 | 4/1984 | Nassimbene | 400/479 |
| 4,450,332 | 5/1984 | Stamm et al. | 200/345 |
| 4,467,150 | 8/1984 | Leitermann et al. | 200/517 X |
| 4,468,542 | 8/1984 | Pounds | 200/517 X |

*Primary Examiner*—Renee S. Luebke

[57] ABSTRACT

A keybutton guide assembly for a full sized keyboard with full travel keybuttons has a structure including a keybutton having a spring actuator engaging a spring finger at a location spaced away from a keybutton stem. This structure causes the keybutton stem to be guided only at an upper end of a stem guide boss for controlling the movement of a keybutton between rest and depressed positions with minimum rubbing friction.

8 Claims, 2 Drawing Sheets

KEYBUTTON GUIDE ASSEMBLY FOR A KEYBOARD

BACKGROUND OF THE INVENTION

1. Field of the Invention

This invention relates to a full sized keyboard with full travel keybuttons for electronic typewriters or the like and, more particularly it relates to a keybutton guide assembly having a structure for controlling the movement of a keybutton between rest and depressed positions with minimum resistance while providing a desirable touch, a low part count and a. relatively flat keyboard 2. Prior Art Known prior art patents disclose low cost keybutton guide assemblies. These patents have significantly different structure relative to each other and relative to the present structure.

A U.S. Pat. No. 3,879,602 issued on Apr. 22, 1975 and invented by Alexander D. R. Walker discloses a low cost keybutton guide assembly. This patent does not provide structure for controlling the movement of the keybuttons between rest and depressed positions.

A U.S. Pat. No 4,188,137 issued on Feb. 12, 1980 and invented by Hugh St. L. Dannatt discloses a keybutton guide assembly having spring fingers for controlling the movement of the keybuttons between rest and depressed positions. However, this patent uses a keylever between the keybutton and the spring finger which increases the part count and the assembly time and which has a significantly different structure relative to the present structure.

A. U.S. Pat. No. 4,269,521 issued on May 25, 1981 and invented by Scott J. Longrod discloses a keybutton guide assembly having structure which includes a spring finger for controlling the movement of the keybuttons between rest and depressed positions. However, this patent uses a keylever between the keybutton and the spring finger which increases the part count and the assembly time and which has a significantly different structure relative to the present structure

SUMMARY OF THE INVENTION

The keybutton guide assembly for a full sized keyboard with full travel keybuttons has a structure for controlling the movement of the keybutton between rest and depressed positions with minimum resistance. The structure also provides a desirable touch, a low part count and a relatively flat keyboard.

This is accomplished by the keybutton having a cross shaped stem guided in a boss integrally formed from a main frame having a cross shaped guide slot and by the keybutton having a spring actuator spaced from the stem. The spring actuator engages a spring finger mounted on the main frame in a manner to guide the stem only at an upper end of the boss to minimize rubbing friction of the stem against the boss during the movement of the keybutton between the rest and depressed positions.

Accordingly, an object of this invention is to provide an efficient and reliable keybutton suspension and guide assembly for a keyboard having a structure for controlling the movement of the keybutton between rest and depressed positions with minimum resistance.

Further objects of this invention are to provide a keybutton guide assembly having a desirable touch, a low part count and a relatively flat keyboard.

Other objects, features and advantages of the invention will become more apparent from the following description, including appended claims and accompanying drawing.

DESCRIPTION OF THE PREFERRED EMBODIMENT

Figure 1:
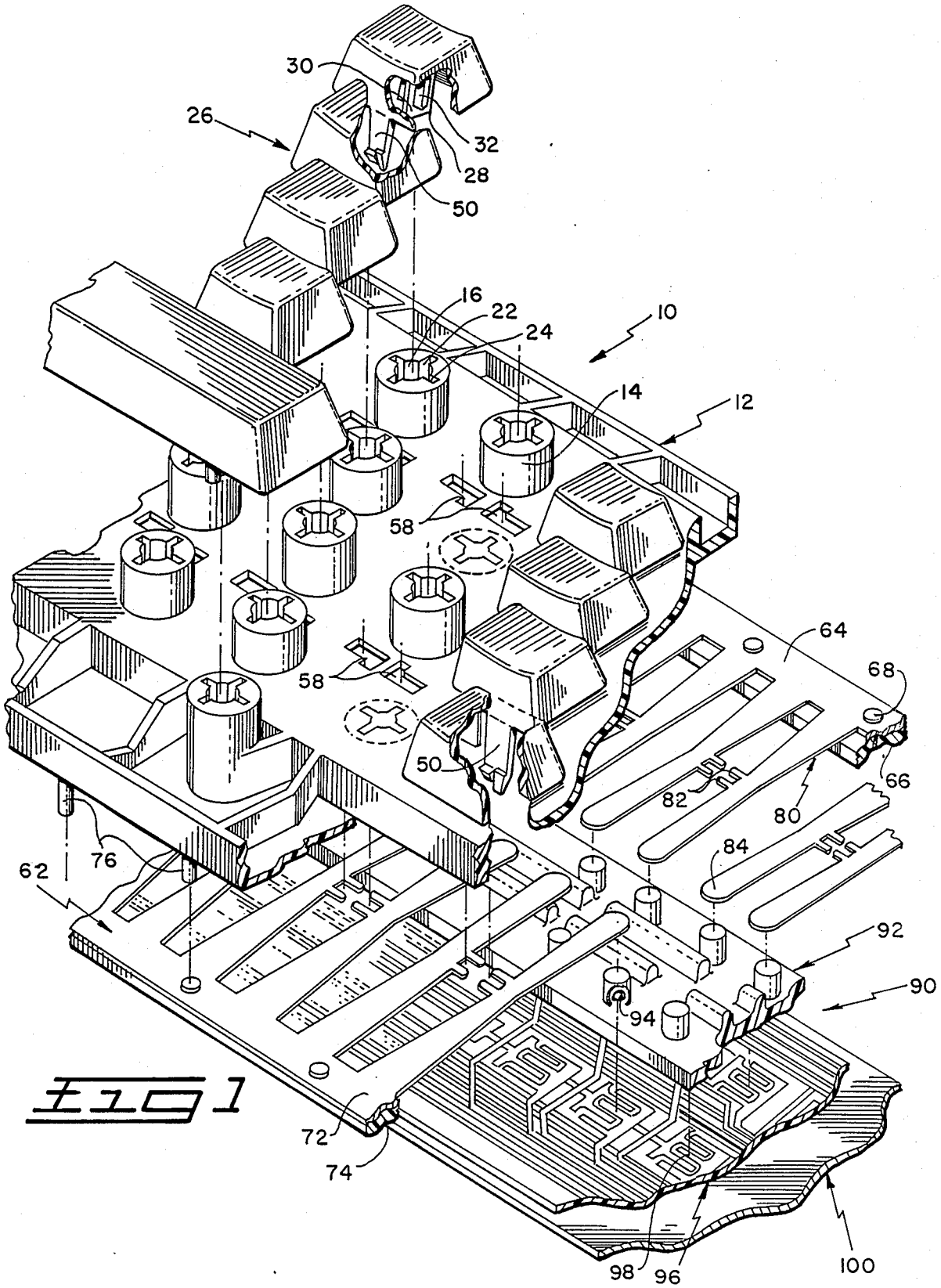
FIG. 1 an exploded view with sections cut away showing the keybutton guide, assembly according to the present invention.
Figure 2:
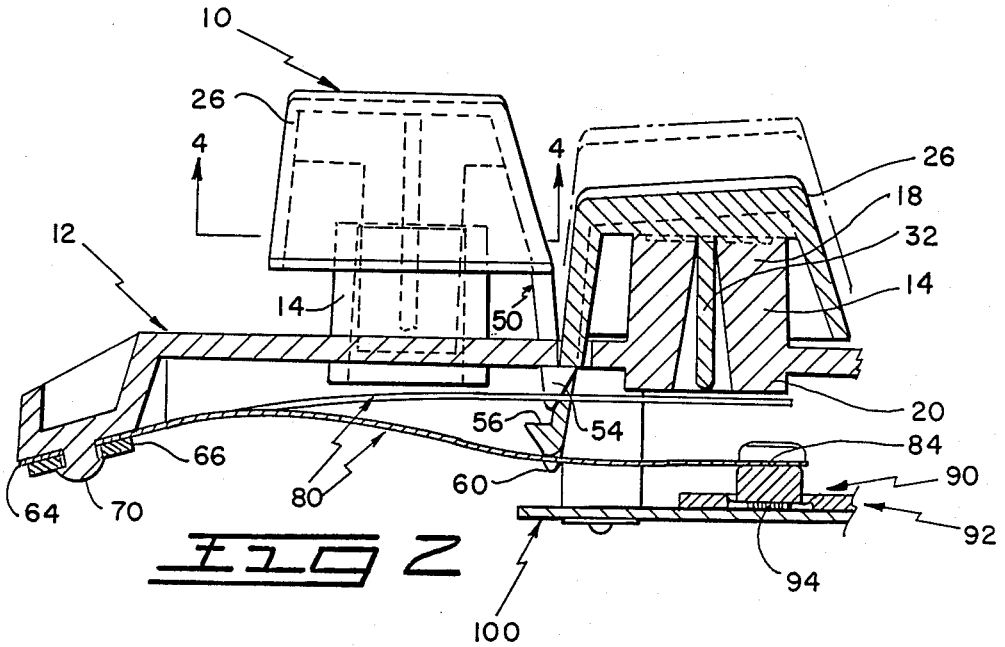
FIG. 2 is a side elevational view showing one keybutton in a rest position and a second keybutton in a depressed position and in section.

A keybutton suspension and guide assembly 10 according to the present invention is shown in FIGS. 1 and 2. A main frame 12 is a molded plastic part with integrally formed cylindrical shaped bosses 14 projecting upward. The boss 14 has a cross shaped guide aperture 16. The guide aperture 16 is tapered along the height of the boss 14 such that the guide aperture 16 is the smallest at the upper end 18 and the largest at the lower end 20. The guide aperture 16 is formed by a first groove 22 crossing a second groove 24.

Figure 4:
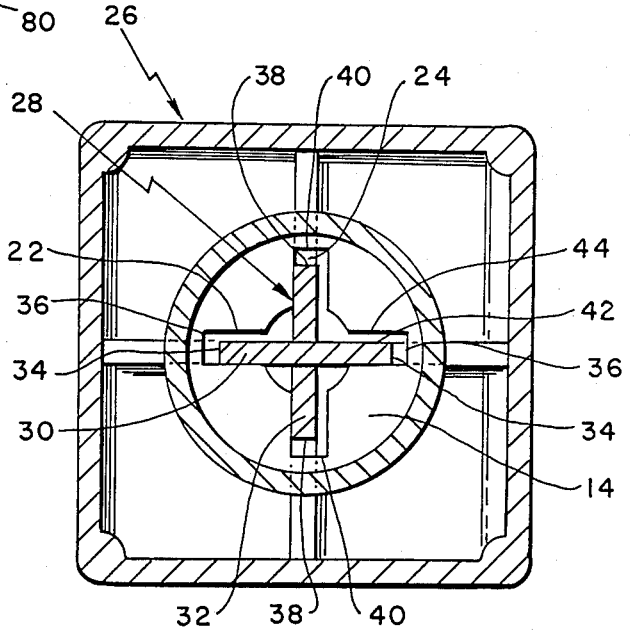
FIG. 4 is an enlarged sectional view taken along line 4—4 of FIG. 2 showing the keybutton cross shaped stem and the main frame boss with the cross shaped slot.

A keybutton 26 has an integrally formed central guide stem 28. The guide stem 28 is formed by cross shaped ribs 30 and 32 which seat in the grooves 22 and 24 (FIG. 4) for guiding the movement of the keybutton 26 between a rest position and a depressed position. The length of the ribs 30 and 32 are shorter than the length of the grooves 22 and 24. The ends 34 of the rib 30 will not touch the ends 36 of the groove 22.

Likewise, the ends 38 of the rib 32 will not touch the ends 40 of the groove 24. Preventing the ends 34 and 38 from touching the ends 36 and 40 avoids an undesirable stick-slip movement of the keybutton 26 during the movement between the rest and depressed positions. The ribs 30 and 32 have walls 42 which are guided by walls 44 formed by the grooves 22 and 24. Having the guide stem 28 guided by the walls 44 of the guide aperture 16 provides a smooth touch for the movement of the keybutton 26 between the rest and depressed positions.

Figure 3:
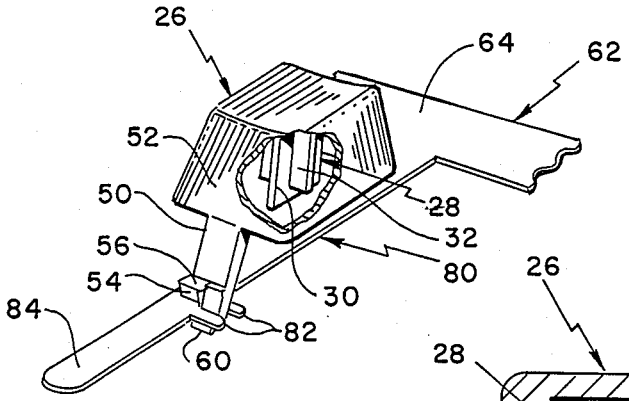
FIG. 3 is perspective view showing a keybutton engaged with a spring finger and a section cut away to show a keybutton stem.

Referring to FIG. 3, the keybutton 26 has a spring actuator 50 integrally formed from a wall 52. An abutment 54 is formed on a first portion of the spring actuator 50. The abutment 54 has a stepped shape hook 56 for passing through an aperture 58 in the main frame 12 and for hooking the underside of the main frame 12 to snap-fit assemble the keybutton 26 to the main frame 12. The snap-fit assembly is provided by the combination of the spring actuator 50 seated in the aperture 58 and the guide stem 28 seated in the grooves 22 and 24 of the boss 14. A control finger 60 is formed on a second portion on the spring actuator 50 and located adjacent to the abutment 54.

Referring now to FIG. 1, a flat sheet steel spring 62 is assembled to the main frame 12 along one border 64 by a sheet metal bar 66. Several plastic posts 68 integrally formed from the main frame 12 extend through the border 64 and through the sheet metal bar 66. The posts 68 are then heated to form heads 70 (only one shown) to rigidly assemble the sheet metal bar 66 and the border 64 of the spring 62 against the main frame 12. The spring 62 is also assembled to the main frame 12 along another border 72 by a second sheet metal bar 74. Several plastic posts 76 integrally formed from the main frame 12 extend through the border 72 and through the sheet metal bar 74. The posts 76 are then heated to form heads (none shown) to rigidly assemble the sheet metal bar 74 and the border 72 of the spring 62 against the main frame 12. The spring 62 has a spring finger 80 integrally extending from the borders 64 and 72 for each keybutton 26. Each spring finger 80 has two parallel projections 82 integrally projecting perpendicular relative to the length of the spring finger 80. Each spring finger 80 has a free end 84.

When a stem 28 of a keybutton 26 is inserted into a guide aperture 16 of a boss 14, the abutment 54 and the control finger 60 of the spring actuator 50 pass through the aperture 58 in the main frame 12. The location of the bosses 14 relative to the projections 82 on the spring fingers 80 causes the control finger 60 to automatically seat between the projections 82 when the hook 56 of the abutment 54 has hooked the underside of the main frame 12 for mounting the keybutton 26 on the main frame 12. When the keybutton 26 has been mounted on the main frame 12, a spring finger 80 engages an abutment 54 for biasing the keybutton 26 to its rest position which is determined by the hook 56 abutting against the underside of the main frame 12 (FIG. 2).

A switch control means 90 is mounted on the main frame 12 below the spring fingers 80. The switch contact means 90 can be any one of several types such as a three layer membrane or a rubber dome array. The switch contact means 90 in the present specification includes a rubber dome switch member 92 which has an electrically conductive switch contact 94 for each keybutton 26. A printed circuit switch panel 96 has a switch circuit pattern 98 in alignment with each switch contact 94. A rigid plate 100 provides a firm support for the printed circuit switch panel 96 and the rubber dome switch member 92 for closing the switch contact 94 and the switch circuit pattern 98.

The operation of the keybutton suspension and guide assembly will now be described. Referring to FIG. 2, a keybutton 26 is shown at a rest position in broken lines and at a depressed position in solid lines and in cross section. When depressing the keybutton 26, the stem 28 of the keybutton 26 is guided at a first location by the upper end 18 of the boss 14. The keybutton 26 is guided at a second location spaced horizontally from the first location by the control finger 60 of the spring actuator 50 seated between the projections 82 on the spring finger 80. The spring finger 80 is pivoted downward relative to the border 64 by the abutment 54 of the spring actuator 50 during depression of the keybutton 26. The free end 84 of the spring finger 80 moves the switch contact 94 into contact with the switch circuit pattern 98 for closing a circuit representing the particular depressed keybutton 26.

During the pivoting movement of the spring finger 80, the projections 82 of the spring finger 80 being spaced horizontally from the boss 14 control the movement of the spring actuator 50 in a manner to cause the stem 28 to remain substantially centered in the boss 14 during the depression of the keybutton 26. Having the stem 28 remain substantially centered in the boss 14, the first guide location of the keybutton 26 is desirably only at the upper end 18 of the boss 14. Guiding the stem 28 at only the upper end 18 of the boss 14 minimizes rubbing friction of the walls 42 of the stem ribs 30 and 32 against the walls 44 of the boss grooves 22 and 24. Since there is very little surface contact of the control finger 60 and the projections 22, there is practically no rubbing friction at this keybutton second guide location.

Therefore, this keybutton suspension and guide assembly 10 has a structure for controlling the movement of the keybutton 26 between the rest and the depressed positions with minimum resistance.

When the depressed keybutton 26 is released, the spring finger 80 is biased to its initial position and the keybutton 26 is biased to its initial position by the spring finger 80 due to tension added to the spring finger 80 responsive to the depression of the keybutton 26 and due to tension added to the spring finger 80 when the spring 62 as initially assembled to the main frame 12. The switch contact 94 is biased to its initial position, when released by the free end 84 of the spring finger 80, due to tension added to the rubber dome switch member 92 responsive to the depression of the keybutton 26.

The keybutton suspension and guide assembly 10 provides a desirable touch by the size and shape of the spring fingers 80 and by the abutment 54 contacting the spring finger 50 at a predetermined distance from the border 64 of the spring 62.

The keybutton suspension and guide assembly 10 has a low part count by the spring actuator 50 of the keybutton 26 directly engaging the spring finger 80 for pivoting the spring finger 80 and for controlling the movement of the keybutton between the rest and depressed positions.

The keybutton suspension and guide assembly 10 provides a relatively flat keyboard of the type having a full travel keybutton and having a full size for typewriters by spacing the spring actuator 50 horizontally relative to the stem 28.

What is claimed is:

1. A keybutton guide assembly for a keyboard having full travel keybuttons, comprising:

a main frame;

a boss integrally formed from the main frame, the boss having an upper and a lower end;

the boss having a guide slot therein, the guide slot being smallest at the upper end and tapered outward to the lower end of the boss;

a guide stem integrally formed from the keybutton seated in the guide slot of the boss for mounting the keybutton on the boss and for guiding the movement of the keybutton between a rest position and a depressed position;

a spring actuator integrally formed from the keybutton;

a spring finger mounted on the main frame; and structure integrally projecting from the spring finger for engagement with the spring actuator of the keybutton for causing the guide stem of the keybutton to be guided by the upper end of the boss to minimize resistance of the movement of the keybutton between the rest position and the depressed position.

2. The keybutton and keybutton guide assembly as defined in claim 1 wherein the engagement of the spring finger and the spring actuator is spaced away from the guide stem.

3. The keybutton and keybutton guide assembly as defined in claim 1 wherein the structure includes two spaced apart projections for receiving the spring actuator therebetween for causing the guide stem of the keybutton to be guided by the upper end of the boss during the movement of the keybutton between the rest position and the depressed position.

4. The keybutton and keybutton guide assembly as defined in claim 1 wherein the spring actuator includes an abutment for engaging the spring finger for pivoting the spring finger downward responsive to the depression of a keybutton.

5. The keybutton and keybutton guide assembly as defined in claim 4 wherein the spring actuator includes a control finger for engaging the structure of the spring finger for causing the guide stem of the keybutton to be guided by the upper end of the boss during movement of the keybutton between the rest position and the depressed position.

6. The keybutton and keybutton guide assembly as defined in claim 5 wherein the control finger is adjacent to the abutment of the spring actuator for engaging the spring finger at substantially the same location along the length of the spring finger.

7. A spring for a full sized keyboard assembly having a main frame, full travel keybuttons for movement between a rest and a depressed position and switch contact means, the spring comprising:

a border assembled to the main frame;

a spring finger integrally extending from the border and having a free end, the spring finger having a predetermined length extending from the boarder to the free end, the spring finger being engaged by a keybutton for moving the free end to the depressed position to actuate the switch contact means; and two spaced apart projections integrally projecting from the spring finger perpendicular relative to the predetermined length of the spring finger and intermediate the border and the free end of the spring finger for receiving a portion of a keybutton therebetween for controlling the movement of the keybutton in a direction substantially parallel to the predetermined length of the spring finger during movement of the keybutton between the rest and depressed positions.

8. The spring as defined in claim 7 further comprising the border forming a single spring having a spring finger integrally extending therfrom for each keybutton on the full sized keyboard assembly, and the two spaced apart projections integrally projecting from each spring finger perpendicular relative to the predetermined length for receiving a portion of a corresponding keybutton.

* * * * *